US005285693A

United States Patent [19]

Sanders et al.

[11] Patent Number: 5,285,693

[45] Date of Patent: Feb. 15, 1994

[54] LAWN MOWER STARTING DEVICE

[76] Inventors: Charles M. Sanders; Douglas E. Sanders, Sr., both of R.R. 3 Box 1134, King George, Va. 22485

[21] Appl. No.: 76,203

[22] Filed: Jun. 11, 1993

Related U.S. Application Data

[63] Continuation-in-part of Ser. No. 944,413, Sep. 14, 1992, Pat. No. 5,253,540.

[51] Int. Cl.[5] ..... F02N 11/12

[52] U.S. Cl. ..... 74/6; 74/139; 123/179.25; 123/185.2

[58] Field of Search ..... 74/6, 7 R, 139, 140, 74/141; 123/179.25, 179.26, 179.28, 179.1, 179.2, 185.2, 185.3, 185.4, 185.5

[56] References Cited

U.S. PATENT DOCUMENTS

| | | | |
|---|---|---|---|
| 1,004,984 | 10/1911 | Buress | 123/185.4 |
| 1,127,710 | 2/1915 | Woods | 123/185.4 |
| 1,211,605 | 1/1917 | McDonnell | 74/140 |
| 3,174,471 | 3/1965 | Weglage et al. | 123/185.5 |
| 3,718,129 | 2/1973 | McKee | 123/179.26 |
| 3,754,543 | 8/1973 | Harkness | 123/185 B |
| 4,047,440 | 9/1977 | Carriera | 74/6 |
| 4,068,644 | 1/1978 | Newport | 123/185 BA |
| 4,109,538 | 8/1978 | Glenday et al. | 74/6 |
| 4,291,654 | 9/1981 | Obermayer | 123/185 BA |
| 4,507,566 | 3/1985 | Leatherman et al. | 123/179.25 X |
| 4,569,315 | 2/1986 | Bodnar | 123/179 SE |
| 4,716,868 | 1/1988 | Reuter | 123/18 SS |
| 4,744,257 | 5/1989 | Yagasaki et al. | 74/6 |
| 4,850,233 | 7/1989 | Ishigo | 74/6 |
| 4,909,200 | 3/1990 | Sumi | 123/179 P |
| 5,174,166 | 12/1992 | Tryon et al. | 74/6 |

*Primary Examiner*—Allan D. Herrmann
*Assistant Examiner*—David W. Laub
*Attorney, Agent, or Firm*—Norman B. Rainer

[57] ABSTRACT

A device for pulling the starter cord of a lawn mower engine utilizes a pulling cable attached to a pulley wheel activated by a high torque electric motor. An elongated base supports an upright post, upon which the motor is mounted. A chute protectively guides the cable as it spans the distance between the pulley wheel and starter cord. A restoring cable, in association with a return wheel and coil spring unwind the pulling cord from the pulley wheel when the motor is deactivated.

4 Claims, 2 Drawing Sheets

LAWN MOWER STARTING DEVICE

RELATED APPLICATIONS

This Application is a continuation-in-part of U.S. patent application Ser. No. 07/944,413 filed Sep. 14, 1992 now U.S. Pat. No. 5,253,540.

BACKGROUND OF THE INVENTION

1. Field of the Invention

This invention relates to apparatus for effecting a starting pull upon the rope of a recoil-start type internal combustion engine.

2. Description of the Prior Art

Small internal combustion engines in the range of 2–10 horsepower are commonly used upon various types of wheeled machines such as lawn mowers, snow blowers, roto-tillers, edgers, cement mixers, generators, air compressors, etc. Such engines typically consist of one or two cylinders and may have an output shaft oriented in either horizontal or vertical disposition.

Numerous starter devices for small engines have been disclosed in the prior art, particularly in attempts to aid in the starting of stubborn engines. For example, U.S. Pat. No. 4,569,315 to Bodnar discloses an electric drill operated device adapted to engage a shaft associated with a small engine. Such devices are of limited adaptability with respect to various engine designs. The benefits of using such devices are diminished because of the measures needed to adapt the starting device to the requirements of the engine.

Crank-spring type starters such as disclosed by U.S. Pat. No. 4,716,868 to Reuter store mechanical energy from a hand crank, said energy being subsequently released by a rachet and pawl. Starters of this type are prone to mechanical failure and therefore are seldom installed upon modern small engines.

The vast majority of small engines currently produced are adapted with a rope-pull-recoil starter such as disclosed in U.S. Pat. No. 4,850,233 to Ishigo. Recoil rope starters utilize a rope wound upon a spool by a recoil spring. The spool is usually geared for mechanical advantage to a clutch which engages an input shaft. The force exerted by a pull upon the rope causes engagement of the clutch, producing rotation of the spool and input shaft, which in turn cycle the engine in order to start it. Upon release of force upon the rope, it is recoiled upon the spool by a recoil spring.

Recoil starting devices having either vertical or horizontal pull strokes have been disclosed. Devices requiring a vertical pull generally utilize the force of gravity to stabilize the machine while the rope is pulled. Often the weight of the machine is great enough to overcome the resistance to the rope pull exerted by the engine cylinder compression upon starting. Some machines are adapted to be stepped upon while starting to further stabilize the machine and provide greater starting force by the person pulling the rope.

However, machines which have a horizontal-pull rope starter and are mounted upon wheels require that the person starting the machine steps upon the machine to stabilize it. The nature of the horizontal pull while stepping upon the machine is often awkward, and requires the person starting the machine to rotate the torso while bending over. This maneuver has been known to cause serious back injuries, and is difficult for back sufferers and elderly persons to perform, particularly with a stubborn starting machine requiring numerous pulls. The problem is particularly experienced by those performing this starting motion often, such as repairmen and landscapers.

It is therefore an object of the present invention to provide an auxiliary starting device for horizontal rope-pull-start engines associated with small machines.

It is another object of the present invention to provide a starting device of the aforesaid nature which is easily adaptable to a variety of engines, requiring no modification of the machine.

It is a further object of this invention to provide a starting device of the aforesaid nature capable of immobilizing the machine against pulling force applied to the rope starter of the engine.

It is yet another object of this invention to provide a device of the aforesaid nature which is easily disengaged subsequent to starting.

Still other objects of this invention are to provide a device of the aforesaid nature which is simple to use, easily maintained, durable, and amenable to low cost manufacture.

These and other beneficial objects and advantages will be apparent from the following description.

SUMMARY OF THE INVENTION

The above and other beneficial objects and advantages are accomplished in accordance with the present invention by an auxiliary starting device for an internal combustion engine associated with a mobile machine, said engine having a recoil type starter with a clutch and a pull cord having a proximal extremity attached to said starter, and a free distal extremity equipped with a pull handle, said machine adapted to rest upon a horizontal surface, said starting device comprised of:

a) a horizontally disposed foundation base elongated between front and rear extremities, b) a support post vertically emergent from said base, c) an abutment surface associated with the front extremity of said base, d) a high torque electric motor mounted upon said support post and having a horizontally directed drive shaft, e) a pulley wheel affixed to said drive shaft for rotation in a vertical plane, f) a pulling cable having a first extremity attached to said pulley wheel and a second extremity configured to removably associate with said pull cord handle, said cable spanning the distance between said pulley wheel and pull cord handle in a substantially horizontal path, g) a chute for protectively guiding said spanning portion of said cable, h) a return wheel positioned above said abutment surface and disposed for rotation in a vertical plane, i) a return cable having a first extremity, and a second extremity attached to the spanning portion of said pulling cable, said return cable passing about said return wheel, j) elongatable restoring means having a free forward extremity attached to the first extremity of said return cable and a rear extremity fixedly associated with the rear extremity of said base, and k) resilient restraining means disposed in parallel relationship to said restoring means and adapted to remain inactive until said restoring means has undergone a predetermined elongation.

In a preferred embodiment, tether means may be attached to the support post and adapted to release the clutch of the starter. The device is preferably constructed primarily from steel components which are welded or bolted together. The cables may be ¼" steel or, alternatively, suitably sized nylon rope. The restoring means may be in the form of a helical spring or alternatively elastic bungee cord or band, producing about 10 lbs. of force.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 3:
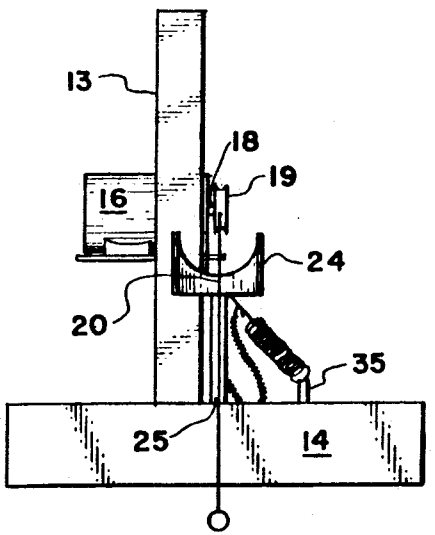
FIG. 3 is a front view of the embodiment of FIG. 1.
Figure 1:
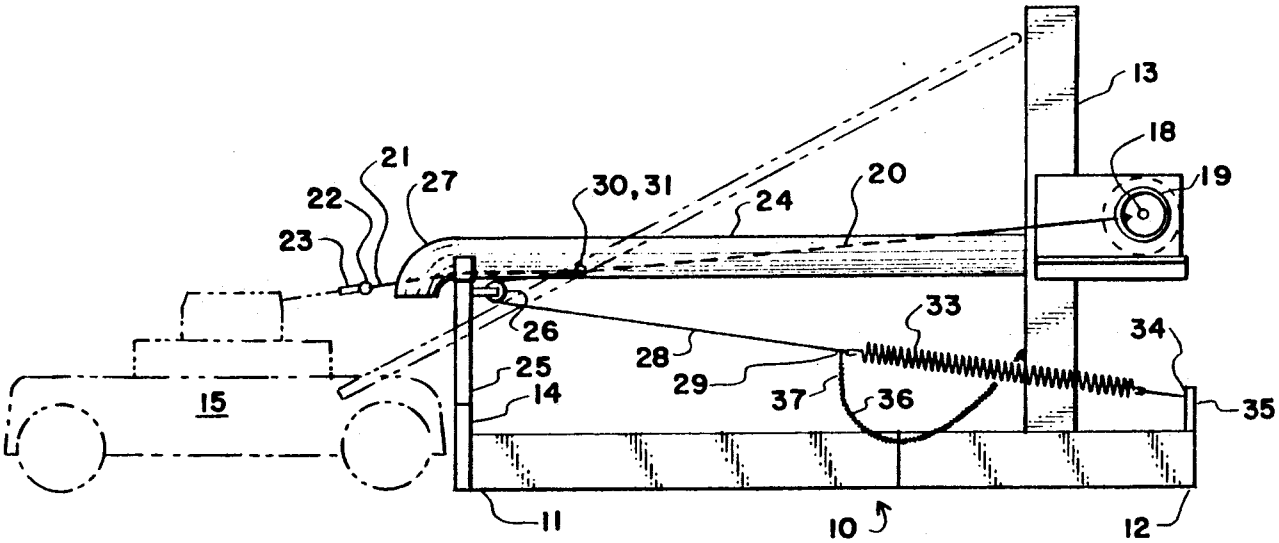
FIG. 1 is a side view of an embodiment of the starting device of the present invention shown in functional association with a lawn mower having a pull-start gasoline engine.
Figure 4:
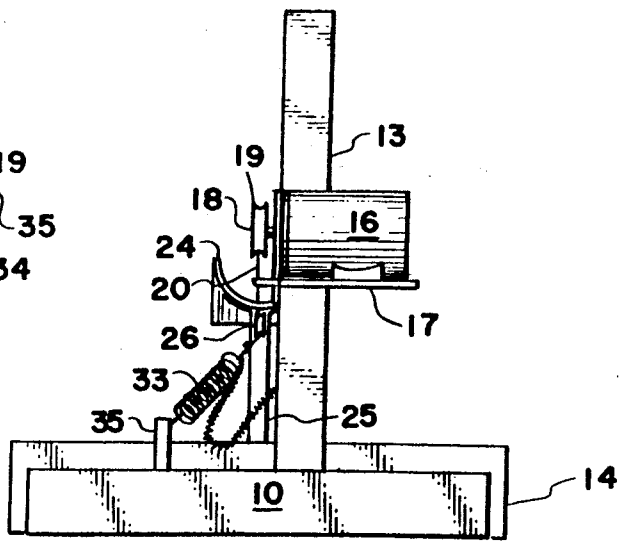
FIG. 4 is a rear view.
Figure 2:
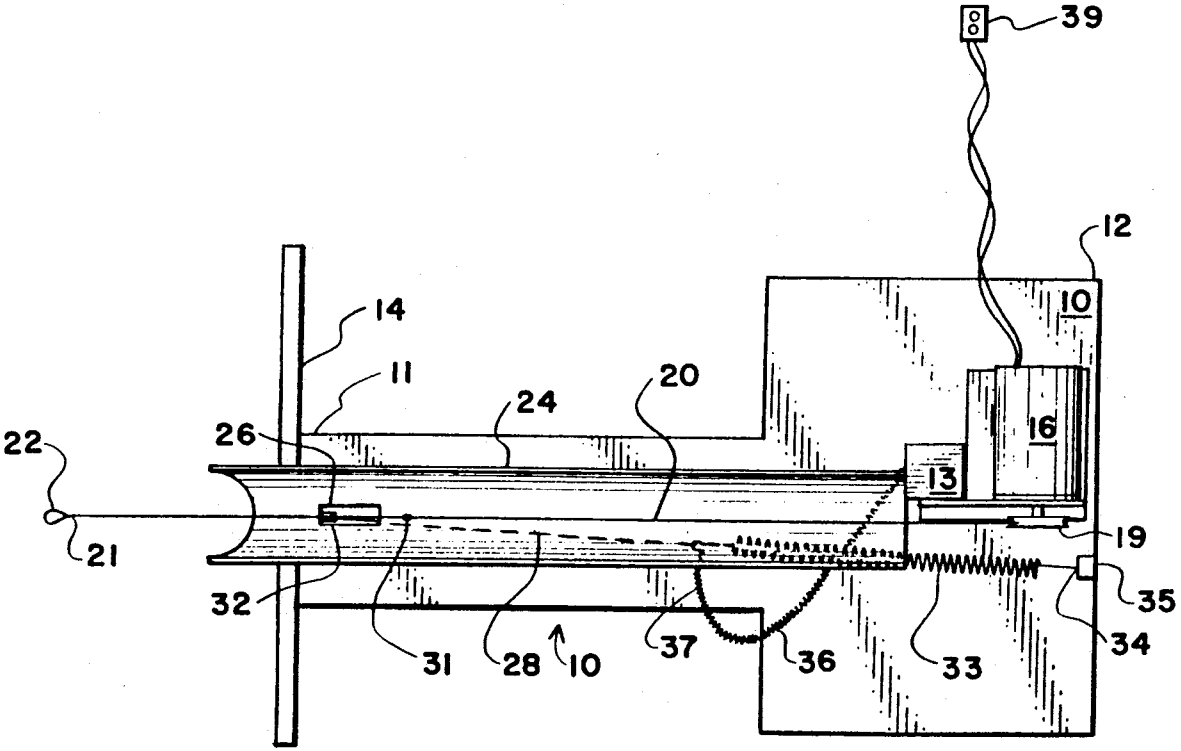
FIG. 2 is a top view of the embodiment of FIG. 1.

Referring to FIGS. 1–4, an embodiment of the starting device of the present invention is shown comprised of a horizontally disposed foundation base 10 elongated between front and rear extremities 11 and 12, respectively, support post 13 vertically emergent from said base, and abutment surface 14 attached to front extremity 11 of the base. The function of said abutment surface is to prevent a lawn mower 15 from moving toward post 13. A support arm 25 is upwardly emergent from abutment surface 14, and terminates in an upper extremity which supports return wheel 26 disposed for rotation in a vertical plane.

A high torque electric motor 16 is mounted by way of support bracket 17 upon post 13. A drive shaft 18, horizontally emergent from said motor, holds pulley wheel 19 in vertical orientation. A clutch mechanism may be interactively disposed between motor 16 and wheel 19.

A pulling cable 20 is attached at its first extremity to pulley wheel 19. The cable thence extends in a straight, substantially horizontal path to a second extremity 21 having means such as loop 22 for removably associating with the pull cord handle 23 of said mower.

A chute 24 of substantially semi-circular sectional configuration is supported by post 13 and support arm 25 in substantially horizontal disposition below pulley wheel 19. The purpose of the chute is to embrace the spanning horizontal portion of cable 20 to ensure that said cable can undergo longitudinal sliding movement without entangling with other components of the device. The chute may be fabricated of a length of PVC pipe which is halved longitudinally. The forward extremity 27 of said chute may be downwardly curved so as to enable extremity 21 of cable 20 be controllably positioned close to said mower. A slot 32, disposed in forward extremity 27 permits the partial protrusion of wheel 26 through said chute.

Return cable 28 has a first extremity 29 and a second extremity 30 attached to the horizontal portion of said pulling cable at a site 31 rearwardly spaced from support arm 25, said return cable passing around the lower and forward portions of wheel 26.

Restoring means in the form of coil spring 33 has a free distal extremity attached to the first extremity 29 of said return cable, and a fixed extremity 34 attached to stud 35 extending upwardly from base 10.

Resilient restraining means in the form of coil spring 36 is connected by slack line 37 to return cable 28. The opposite, rear extremity of spring 26 is anchored to base 10.

By virtue of the aforesaid components and their interaction, a lawnmower or other comparable mobile machine can be secured at the forward extremity of the base. Pulling cable 20 may then be attached to the pull cord of the engine. Activation of motor 16 by use of start-stop switch 39 winds cable 20 onto wheel 19, causing a rearward pull on the pull cord with sufficient force to start the engine. Upon deactivation of the motor, the restoring means causes cable 20 to unwind from wheel 19, thereby reverting to the initial state of the cables.

The restraining coil spring 36 serves to prevent excessive rearward travel of cable 20 onto pulley wheel 19.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An auxiliary starting device for an internal combustion engine associated with a mobile machine, said engine having a recoil type starter with a clutch and a pull cord having a proximal extremity attached to said starter, and a free distal extremity equipped with a pull handle, said machine adapted to rest upon a horizontal surface, said starting device comprised of:

a) a horizontally disposed foundation base elongated between front and rear extremities, b) a support post vertically emergent from said base, c) an abutment surface associated with the front extremity of said base, d) a high torque electric motor mounted upon said support post and having a horizontally directed drive shaft, e) a pulley wheel affixed to said drive shaft for rotation in a vertical plane, f) a pulling cable having a first extremity attached to said pulley wheel and a second extremity configured to removable associate with said pull cord handle, said cable spanning the distance between said pulley wheel and pull cord handle in a substantially horizontal path, g) a chute for protectively guiding said spanning portion of said cable, h) a return wheel positioned above said abutment surface and disposed for rotation in a vertical plane, i) a return cable having a first extremity, and a second extremity attached to the spanning portion of said pulling cable, said return cable passing forwardly about said return wheel, j) elongatable restoring means having a free forward extremity attached to the first extremity of said return cable and an anchored rear extremity, and k) resilient restraining means disposed in parallel relationship to said restoring means and adapted to remain inactive until said restoring means has undergone a predetermined elongation.

2. The starting device of claim 1 further comprising tether means attached to said support post and configured to release the clutch of said starter.

3. The starting device of claim 1 wherein said elongatable restoring means is a helical spring.

4. The starting device of claim 3 wherein said spring produces about 10 pounds of force.

* * * * *